United States Patent [19]

Lah et al.

[11] 4,023,817

[45] May 17, 1977

[54] SKI POLE WITH WARNING DEVICE

[76] Inventors: Josef Lah, 31020 Meadowbrook Drive, Willoughby Hills, Ohio 44094; Anthony M. Gentile, 25080 Edgemont Drive, Richmond Heights, Ohio 44124

[22] Filed: Aug. 29, 1975

[21] Appl. No.: 609,024

[52] U.S. Cl. ..... 280/11.37 B

[51] Int. Cl.[2] ..... A63C 11/22

[58] Field of Search ..... 280/11.37 B, 11.37 D, 280/11.37 H, 11.37 L; 135/DIG. 10; 240/6.42, 10 R, 106 R

[56] References Cited

UNITED STATES PATENTS

| | | | |
|---|---|---|---|
| 2,173,624 | 9/1939 | Dyer | 135/DIG. 10 |
| 2,473,158 | 6/1949 | Luekens, Jr. | 280/11.37 B |
| 2,997,042 | 8/1961 | Mitchell | 280/11.37 H |
| 3,246,907 | 4/1966 | Chisholm | 280/11.37 E |
| 3,488,485 | 1/1970 | McGann | 240/106 R |

FOREIGN PATENTS OR APPLICATIONS

| | | | |
|---|---|---|---|
| 642,554 | 6/1962 | Italy | 280/11.37 H |
| 1,142,842 | 2/1969 | United Kingdom | 135/DIG. 10 |

*Primary Examiner*—Joseph F. Peters, Jr.
*Assistant Examiner*—David M. Mitchell

[57] ABSTRACT

There is disclosed herein a ski pole having a tubular handle end portion containing a warning signal device actuatable by a button or the like disposed at the end of the ski pole grip. The warning signal comprises either an audible signal or a visual signal transmitted through the wall of the pole which may contain light diffusive material providing a sparkling effect. The warning signal device is either mechanically or electrically operated.

3 Claims, 8 Drawing Figures

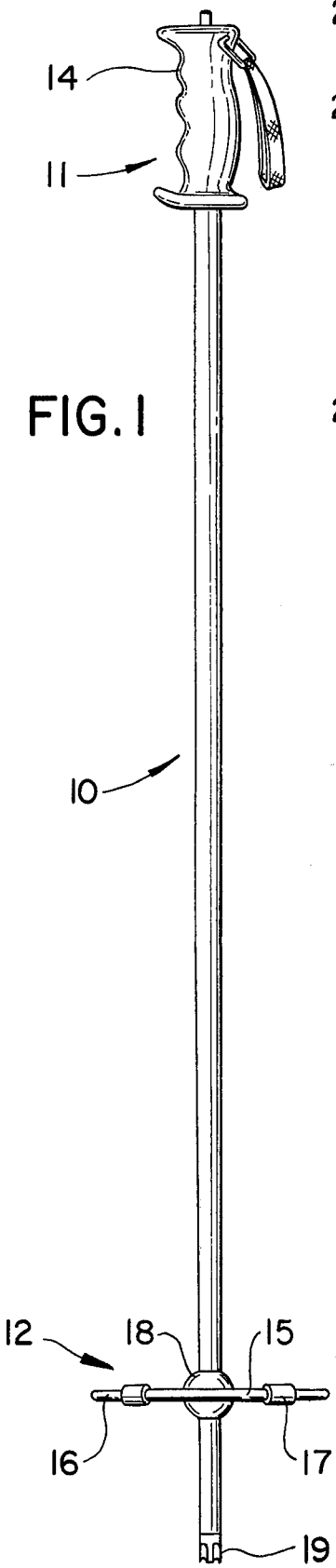
FIG. 1
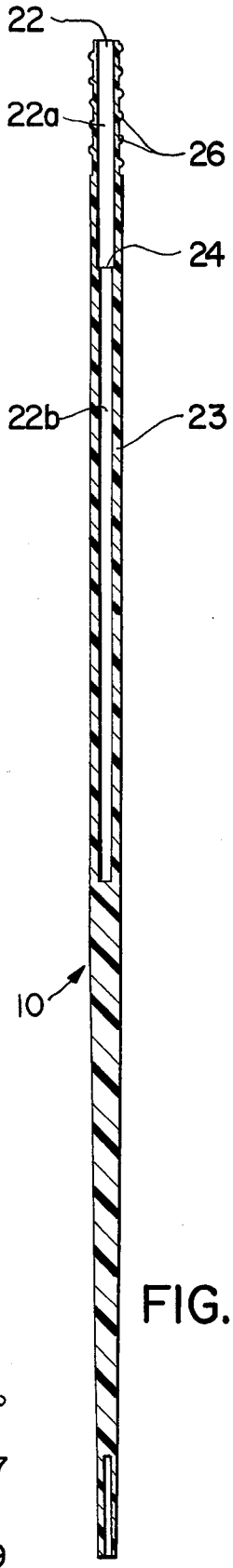
FIG. 2
FIG. 3
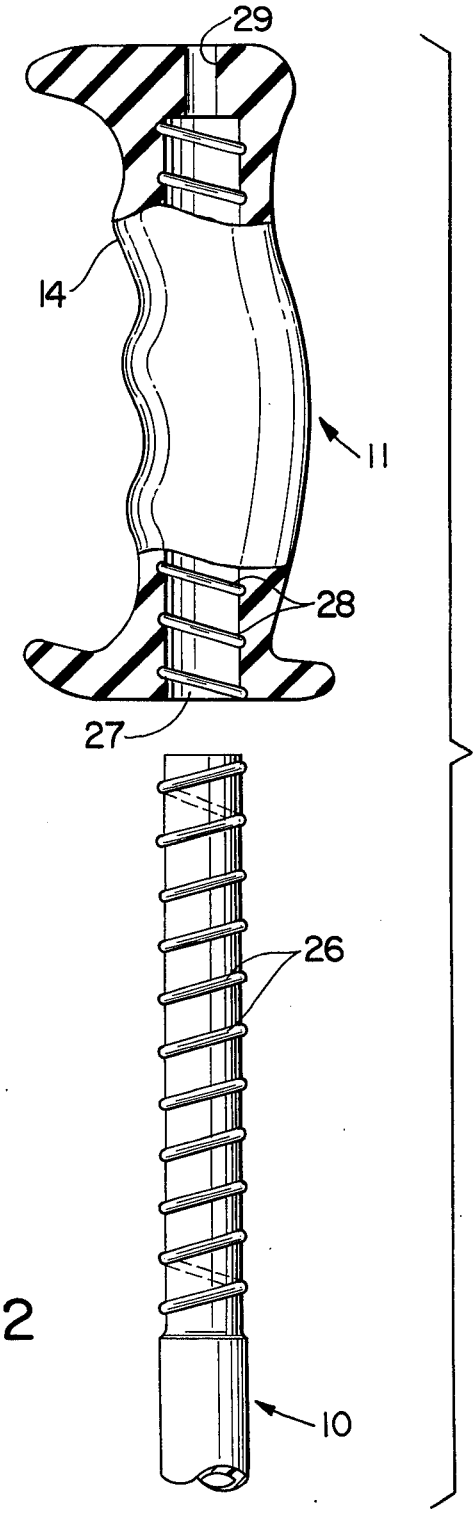

FIG.4
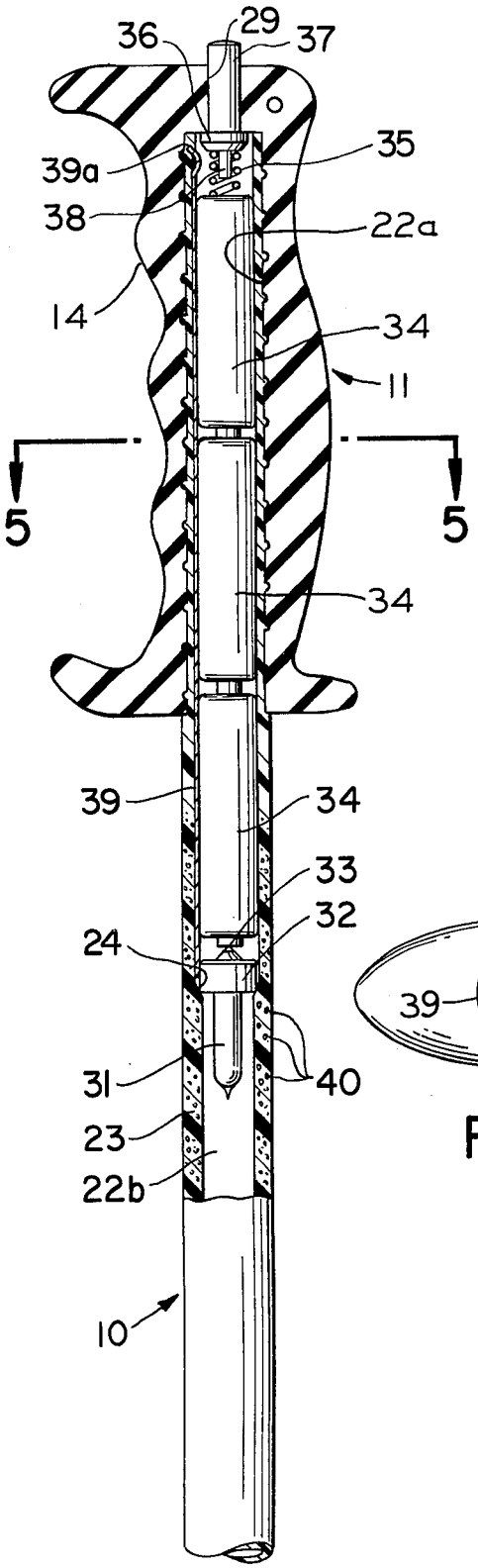
FIG. 6
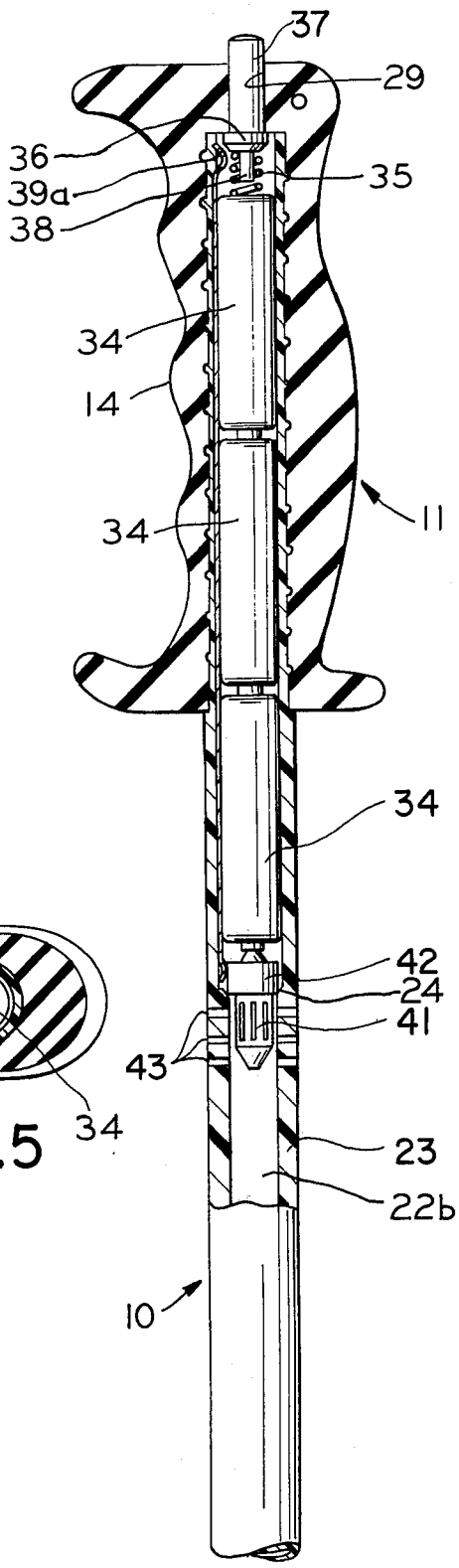
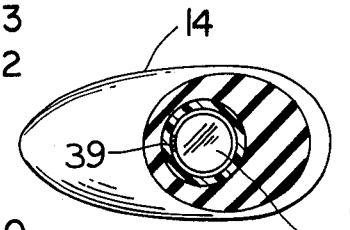
FIG.5

SKI POLE WITH WARNING DEVICE

This invention relates to ski poles and particularly to ski poles containing warning devices which are either audible or visual.

It is well known that the sport of skiing can subject the enthusiast to considerable threat of accidental injury particularly on slopes and ski runs which are crowded and enable the skiers to attain a substantial downhill speed. One constant danger under these circumstances is that one swiftly moving skier may run into another, slower moving skier who inadvertently steps or skis into the path of the first skier. Such accident can occur both in daylight and in twilight or substantially darkened conditions when ski slopes are still in use. To the present inventor's knowledge, no means other than the human voice is presently generally available to skiers to serve as a warning device alerting other people to stay out of their paths.

The present invention comprises a ski pole providing a warning device whereby swiftly moving skiers can warn others of their approach, and other skiers in their paths can be seen and avoided. The general object of the invention is to provide such ski pole which is both useful and practical and serves to make skiing in general a safer pastime.

Another object of the invention is to provide a ski pole having a warning signal device which emits an audible warning signal.

Still another object of the invention is to provide a ski pole having a warning signal device which is especially visible under semidark or darkened conditions.

Still another object of the invention is to provide a ski pole having a warning signal device which is easily and quickly installed or replaced as needed.

Still another object of the invention is to provide a warning device as set forth above which is readily available for operation by the skier at any time without jeopardizing his hold on the ski poles or his concentration on skiing.

Other objects of the invention and a number of the advantages thereof will be readily apparent from the following description of four embodiments of the invention as shown in the accompanying drawings, in which said drawings:

FIG. 1 is a side elevation of one embodiment of the ski pole of this invention;

FIG. 2 is a longitudinal section through the shaft only of the ski pole;

FIG. 3 is an enlarged exploded elevational view of the upper end portion of the shaft and a detachable handgrip therefor, said handgrip being shown in partial section;

FIG. 4 is an enlarged longitudinal sectional view of the handgrip and upper shaft end portion of FIG. 1;

FIG. 5 is a transverse section taken along the line 5—5 of FIG. 4;

FIG. 6 is a view similar to FIG. 4 showing a second embodiment of the invention;

Figure 7:
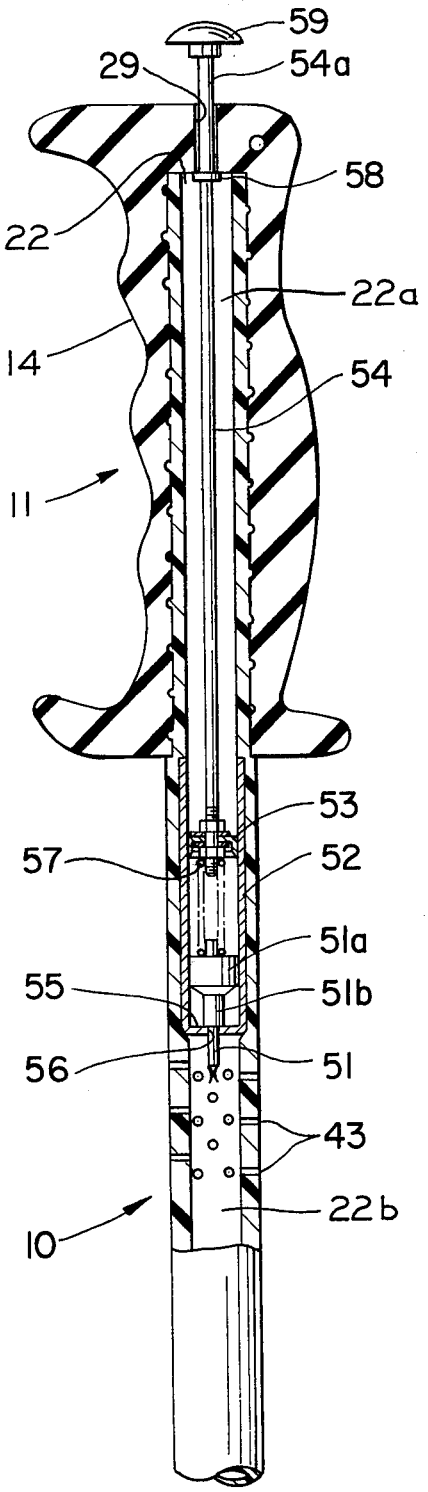
FIG. 7 is a view similar to FIG. 4 showing a third embodiment of the invention.

Referring now to the drawings in all of which like parts are designated by like reference numerals, and particularly to FIGS. 1 and 2, the ski pole of this invention comprises an elongated shaft 10 having an upper handle end portion generally indicated at 11 and a lower basket end portion generally indicated at 12. The upper handle end portion 11 is provided with a handgrip 14, the details of which will be herein later described in detail. The lower basket end portion 12 is provided with a basket 15 of conventional form comprising a metallic ring 16 connected by a resilient web member 17 having a central hub 18 telescoped over and spaced upwardly a short distance above the lower end of the shaft 10 in a known manner. The lowermost end of said shaft is preferably provided with a steel reinforcing tip 19.

Referring now to FIG. 2 of the drawings, the shaft 10 is preferably made of a suitable plastic such as a polyurethane the major upper portion of which is cylindrical and the lower portion of which tapers downwardly toward to the tip 19. The upper end portion is of hollow, tubular form and thereby provides an upwardly opening socket 22. The socket 22 comprises an upper portion 22*a* which is slightly larger in diameter than the lower portion thereof indicated at 22*b*. Thus the upper, tubular portion of the shaft comprises a circumferential wall 23 having an inwardly projecting step 24 between the portions 22*a* and 22*b* spaced axially inwardly from the upper end of the pole.

The extreme upper end portion of the shaft 10 is also provided with external screw threads 26, best seen in the enlarged view of FIG. 3, adapted to engage internal threads 28 of an internally threaded cavity 27 in the handgrip 14. The cavity 27 of the handgrip 14 terminates a short distance below the upper end of said handgrip and is there provided with an aperture or through bore 29 the purpose of which will become evident in connection with the disclosure of FIG. 4. The handgrip is preferably made from a substantially rigid plastic or hard rubber having only slight flexibility, if any. From the foregoing it will be readily understood that the handgrip 14 is detachably screwed on to the extreme upper end portion of the shaft 10 thereby generally closing the upper end of the socket 22 but affording an access passage or bore 29.

FIG. 4 illustrates the manner in which the upper portion 22*a* of the socket 22 affords means for mounting a signal device, in this instance an electric bulb 31. The bulb 31 has an enlarged base 32 whereby the same is adapted to seat against the step 24. Thus the bulb 31 projects downwardly into the lower portion 22*b* of the socket 22 whereas the bulb contact 33 projects upwardly. A plurality of small flashlight batteries 34 are disposed above the contact 33 and are spring biased into engagement therewith by a coil spring 35 engaging the uppermost battery 34. The coil spring 35 also engages an enlarged switch contact portion 36 of a switch button 37 which preferably projects slidably upwardly through the aperture of through bore 29. The switch contact portion 36 also includes a downwardly projecting pin portion 38 which serves to center the coil springs 35 and is adapted to contact the bottom end of the uppermost battery 34 when the switch button 37 is depressed. A conductor strip 39 extends through the upper socket portion 22*a* from a point in contact with the electric bulb base 32 to a position adjacent to the switch contact portion 36 at the extreme upper end of the shaft 10. The extreme upper end of the conductor strip 39 is slightly bowed as shown at 39*a* whereby the same will contact the switch contact portion 36 when the same is depressed to complete the circuit to the electric bulb 31. Thus, the switch button 37 for actuating the bulb 31 is located at the upper end of the handgrip where it is accessible by the thumb. This is the preferred location because operation of the switch does not interfere with the skiers grip on the ski pole.

Where the warning signal comprises a light as shown in the embodiment of FIG. 4, the tubular wall 23 is either transparent or translucent whereby the light glows through the shaft 10 and is visible in twilight or darkened conditions. The lower portion 22*b* of the socket 22 extends a substantial distance downwardly whereby the ski pole affords a lighted area of substantial length.

To enhance and reinforce the visual warning effect of the ski pole as shown in FIG. 4, the transparent or translucent wall 23 may incorporate a particular color such as red and, alternatively or in addition thereto, be provided with discrete units or fragments 40 (FIG. 4) of light diffusive material. The units 40 are preferably loosely spaced and uncrowded whereby light will reflect back and forth between the units and afford an overall sparkling effect to the glowing portion of the shaft 10.

In the form of the invention shown in FIG. 6, all of the parts thereof are substantially similar to and have the same reference numerals as the elements of FIG. 4 with the exception of the signal device which comprises a sound unit 41. The sound unit has an enlarged base 42 which seats upon the step 24 in the same manner as the electric bulb 31 of the first form of the invention. The sound unit 41 is adapted to be activated by depressing the switch button 37 in exactly the same manner as set forth with respect to said prior embodiment. In the form of FIG. 6, the tubular portion of the shaft 10 is provided with a plurality of apertures 43 in the wall 23 whereby the sound may be freely emitted. The apertures 43 may also be provided in the form of the invention shown in FIGS. 1–5 for allowing light to shine outwardly either in place of or in combination with a transparent or translucent pole.

The form of the invention shown in FIG. 7 comprises a shaft 10 in combination with a screw thread fitted handgrip 14 of substantially the same form disclosed in FIG. 6. However, in this form of the invention a sound unit 51 is adapted to be activated by a stream of compressed air. To provide means for energizing or activating said sound unit, said unit is mounted in a cylindrical housing 52 which also houses a piston 53 having an upwardly projecting piston rod or shaft 54. The housing 52 has a lowermost end wall 55 centrally apertured at 56 to allow said sound unit to project downwardly and outwardly of the housing into the tubular portion of the shaft 10 having the aforementioned sound emitting apertures 43. Said sound unit is biased downwardly or toward the end wall 55 by means of a coil spring 57 compressively disposed between an upper end portion 51*a* of said sound unit and the piston 53. An intermediate portion 51*b* is larger in diameter than the central aperture 56 thereby limiting the downward projection of the sound unit 51.

The piston rod or shaft 54 is preferably provided with a collar 58 spaced downwardly a short distance from the uppermost end of said piston rod whereby to limit the upward or return movement of the piston 53. The extreme upper portion of the piston rod 54, indicated at 54*a* projects upwardly through bore or aperture 29 in the handgrip 14 and is surmounted by a preferably detachable button or cap 59. Thus upon removal of the button 59, the handgrip 14 can be unscrewed and all parts of the sound unit and energizing or power means are accessible for adjustment, repair, or replacement.

Figure 8:
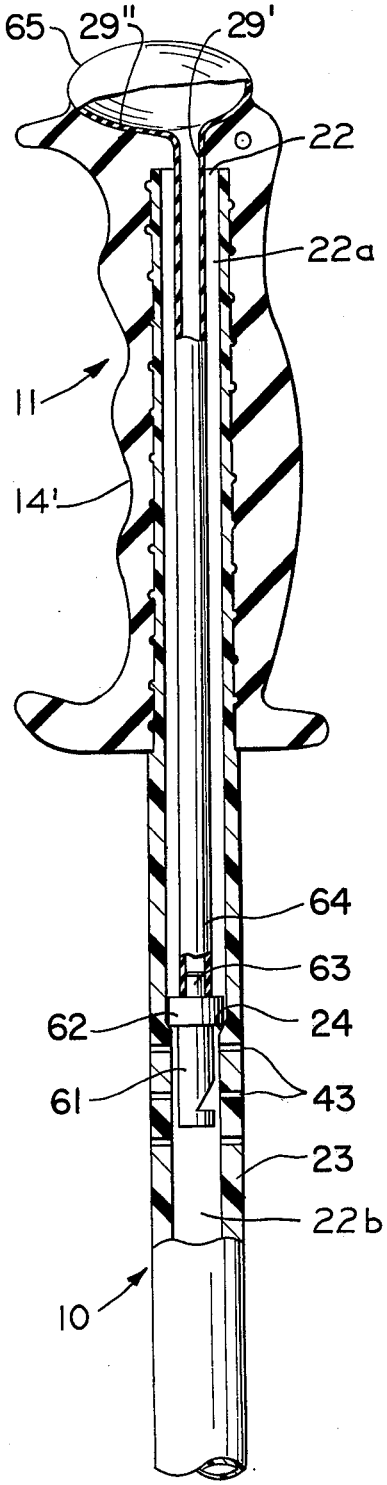
FIG. 8 is also a view similar to FIG. 4 showing a fourth embodiment of the invention.

The final form of the invention shown in FIG. 8 also incorporates an air activated sound unit 61. Said sound unit has an enlarged collar 62 seated against the step 24 in the shaft wall 23. A cylindrical nipple 63 projects upwardly above the collar 62 and has the downwardly directed end of a plastic or similar tube 64 tightly telescoped thereover. The tube extends upwardly through an aperture 29′ in the upper end of a modified handgrip 14′. The upper end of the tube 64 terminates in a flexible bulb 65 of generally eliptical section the lower portion of which nests within a complementary shaped cavity 29″ provided in the upper end of the handgrip 14′ and intersecting the aperture 29′. The upper end of the tube 64 is preferably a snug fit within the aperture 29′ to prevent dislodging the bulb 65.

From the foregoing, it will be readily seen that in a ski pole incorporating either of the forms of the invention shown in FIGS. 7 and 8, an air activated sound device can be readily energized or activated by the use of pressure applied in the forms shown by the thumb at the top of the handgrip thereby depressing either the button 59 for compressing air within the cylindrical housing 52 or the bulb 65 for compressing the air within the tube 64. In either case, compressed air is caused to flow sharply through a sound unit to actuate the same, the sound being emitted through the apertures 43 in the wall 23.

It is anticipated that the ski poles of this invention may be provided in pairs wherein one ski pole has a visual warning device and the other ski pole incorporates an audible warning device. Thus a descending skier can warn those in his path either by an audible or visual warning, or both, as the need arises. Also, the descending skier can readily ascertain the presence of another skier in his path.

It will be understood that in the ski poles incorporating audible warning signals, no part of the shaft 10 need necessarily to be made of a transparent or translucent material and if so, the discrete units or fragments 40 may or may not be used.

It will be further understood that many changes in the details of the invention as herein described and illustrated may be made without, however, departing from the spirit thereof or the scope of the appended claims.

We claim:

1. A ski pole having an upper handle end portion and a lower basket end portion;

said handle end portion being tubular and affording a socket which opens at the upper end of said pole;

said basket end portion being solid;

said socket being defined by a peripheral wall;

said wall having a radially inwardly projecting step spaced axially inwardly from the upper end of said pole and external screw threads disposed on said upper handle end portion;

a signal device disposed within said socket and retained against downward movement by said step;

signal energizing means disposed in said socket above said signal device;

a handgrip having an internally threaded cavity whereby said handgrip is detachably thread fitted to said handle end portion;

a manually movable actuator member carried by the upper end of said handgrip, said energizing means responsively connected to said actuator member for causing said energizing means to actuate said signal device;

said wall including means affording transmission of said signal outwardly of said ski pole, and said signal device is adapted to produce a visual warning signal in response to movement of said actuator member.

2. A ski pole as set forth in claim 1 wherein said signal device comprises an electric bulb;

said socket wall comprising light transmittable material whereby the light from said electric bulb causes at least a portion of said ski pole to glow in the dark.

3. A ski pole as set forth in claim 1 wherein said socket wall contains discrete units of light diffusive material which causes said pole to sparkle.

* * * * *